US005564761A

United States Patent [19]

Mizuki et al.

[11] Patent Number: 5,564,761

[45] Date of Patent: Oct. 15, 1996

[54] DOOR LOCK DEVICE WITH AUTOMATIC CLOSING MECHANISM

[75] Inventors: Tetsuro Mizuki, Nirasaki; Jiro Mitsui, Kofu, both of Japan

[73] Assignee: Mitsui Kinzoku Kogyo Kabushiki Kaisha, Tokyo, Japan

[21] Appl. No.: 615,072

[22] Filed: Mar. 14, 1996

Related U.S. Application Data

[63] Continuation of Ser. No. 177,977, Jan. 6, 1994, abandoned.

[30] Foreign Application Priority Data

Jan. 13, 1993 [JP] Japan ..... 5-206936
Jan. 28, 1993 [JP] Japan ..... 5-006128 U

[51] Int. Cl.[6] ..... E05C 3/06

[52] U.S. Cl. ..... 292/201; 292/341.16

[58] Field of Search ..... 292/201, 341.16, 292/DIG. 23, DIG. 43, DIG. 56, DIG. 62

[56] References Cited

U.S. PATENT DOCUMENTS

| | | | |
|---|---|---|---|
| 3,989,287 | 11/1976 | Sheesley | 292/201 |
| 4,395,064 | 7/1983 | Bellot | 292/201 |
| 4,762,348 | 8/1988 | Matsumoto | 292/201 |
| 4,815,775 | 3/1989 | Mertin | 292/201 |
| 5,020,838 | 6/1991 | Fukumoto | 292/DIG. 56 |
| 5,158,330 | 10/1992 | Weyerstall | 292/DIG. 43 |
| 5,180,198 | 1/1993 | Nakamura | 292/DIG. 43 |
| 5,222,775 | 6/1993 | Kato | 292/201 |
| 5,232,253 | 8/1993 | Tamiya | 292/201 |
| 5,273,324 | 12/1993 | Kobayashi | 292/201 |
| 5,273,325 | 12/1993 | Zimmerman | 292/DIG. 43 |

FOREIGN PATENT DOCUMENTS 2200982 8/1990 Japan .

*Primary Examiner*—Steven N. Meyers
*Assistant Examiner*—Gary Estrewsky
*Attorney, Agent, or Firm*—Browdy and Neimark

[57] ABSTRACT

A door lock device with an automatic door closing mechanism comprises a lock body having a recess on its front surface side, a latch adapted to be engaged with a striker so as to be rotated from an open position to a full-latch position by way of a half-latch position, a ratchet adapted to be engaged with the latch so as to hold the engagement between the latch and the striker, an actuator adapted to be operated when the latch is rotated to the half-latch position, an output lever adapted to be rotated by power of the actuator, and a link lever adapted to be rotated by rotation of the output lever so as to move the latch from the half-latch position to the full-latch position. The latch, the ratchet and the link lever are stored in the recess of the lock body, and the output lever is provided on the rear surface side of the lock body.

8 Claims, 12 Drawing Sheets

DOOR LOCK DEVICE WITH AUTOMATIC CLOSING MECHANISM

This application is a continuation of application Ser. No. 08/177,977, filed Jan. 6, 1994, now abandoned.

BACKGROUND OF THE INVENTION

The present invention relates to a door lock device, and in particular, a door lock device incorporating an automatic closing mechanism for completely closing a door which is not yet fully latched.

Prior Art

Conventionally, so many persons have experienced such a fact that when a side door of an automobile is to be closed, the door suspends halfway without being fully closed, and accordingly, the door has to be closed again. Although it may simply be said that this fact would occur if the force of closing the door is smaller than the rotary resistance of the door, the larger the force of closing the door, the higher the closing sound is issued, annoying a person in the passenger compartment of the automobile. Accordingly, the door should be closed with a moderate force learned by experience.

Japanese Patent Application Laid-Open No. HEI 2-200982 proposes the provision of an automatic close mechanism in the door lock device, which closes the door in a fully latched condition by means of the force of an electric motor when the door is not fully closed so as to suspend in a half latch condition.

The above-mentioned disclosed example, as shown in FIGS. 13 to 15, comprises a lock body A having, in its front surface, a recess B which is covered substantially by a metal plate; a latch C adapted to be engaged with a striker D fixed to the vehicle body so as to be rotated from an open position to a full-latch position by way of a half-latch position; a ratchet E adapted to be engaged with the latch C so as to hold the engagement between the latch C and the striker D; an actuator F adapted to be energized when the latch C is rotated so as to come to the half-latch position; an output lever H adapted to be rotated around a first shaft G by the power of the actuator F; a link lever J coupled to the latch C through the intermediary of a second shaft I; an intermediate lever K rotatably journalled to the first shaft G and adapted to be engaged with the link lever J; an open lever L coupled to an open handle of a door, for releasing the ratchet E from the latch C when it is rotated; and a movable rod M connecting the outlet lever H with the intermediate lever K. The intermediate lever K is engaged with the link lever J so as to rotate the link lever J and the latch C when the intermediate lever K is rotated by the actuator F through the intermediary of the output lever H.

The above-mentioned known example also incorporates a safety mechanism which interrupts the door closing operation of the actuator when the open lever L is rotated if an expected accident such that a hand is caught by the door and so forth occurs. When the open lever L is rotated, a lever N coupled to the open lever L is engaged with the movable rod M which is therefore moved in a direction indicated by the arrow Y so as to release the coupling between the output lever H and the intermediate lever K, resulting in that the transmission of the power to the latch C is interrupted.

However, the above-mentioned known example offers such a first one of problems which is caused by a fact such that the power transmission members such as the output lever H and the intermediate lever K are attached to a back plate O which is attached to the rear surface of the body A, perpendicular thereto. That is, the intermediate lever K journalled to the plate O and the link lever J journalled to the body A have their rotating planes which are orthogonal to each other, and accordingly, they are frictionally engaged with each other. Further, the force of the actuator F for rotating the intermediate lever K is powerful, and accordingly, the friction force effected between the intermediate lever K and the link lever J becomes larger. As a result, both levers are worn excessively, and a loss in transmission of the force is not negligible.

Further, the known example offers a second one of problems such that the number of necessary components is large since the movable rod M cannot be attached to the open lever L.

Further, U.S. patent application Ser. No. 07/986,396 to the same Assignee as that of the present application, discloses a lock device having an output lever coupled to an actuator and located in a recess in a lock body. However, the output lever has a relatively large sector shape so that the lock body has to have a large size in order to ensure a sufficient space for rotating the output lever within the recess.

SUMMARY OF THE INVENTION

Accordingly, one object of the present invention is to provide a lock device in which power transmission members including an actuator and a latch are arranged in parallel with the rotating surface of a latch so as to overcome the above-mentioned first problem.

Further, another object of the present invention of the present invention is to provide a miniature lock device in which the power transmission members are distributed on two sides, the front and rear sides of the lock body.

Further, another object of the present invention is to provide a safety mechanism having fewer components.

BRIEF DESCRIPTION OF THE INVENTION

Other features and advantages of the invention will be apparent from the following description taken in connection with the accompanying drawings wherein.

DESCRIPTION OF PREFERRED EMBODIMENTS OF THE INVENTION

Figure 1:
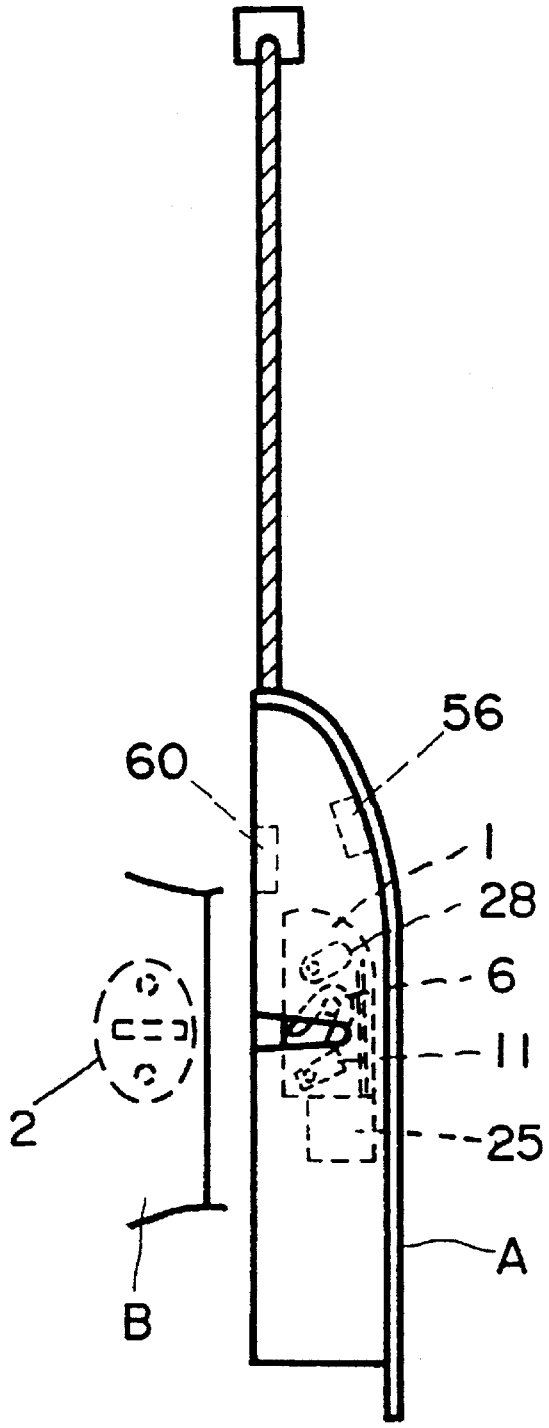
FIG. 1 is a schematic structure view illustrating a locking apparatus according to the present invention.

In the illustrating embodiment of the invention as disclosed in the drawings, a door lock device according to the present invention is composed of a locking apparatus 1 attached on the door A side, and a striker 2 attached on the vehicle body B side. The lock apparatus 1 has a lock body 3 made of synthetic resin which is formed on its front side with a recess 5 adapted to be covered by a metal plate 4 (refer to FIG. 12).

A latch 6 adapted to be engaged with and rotate by striker 2, is rotatably journalled to a latch shaft 7 in a substantially middle height position of the recess 5. A small protrusion 8 is formed on the rear surface side of the latch 6 so as to enter a substantially arcuate groove 9 which is formed in the lock body 3, being laid around the latch shaft 7. The arcuate groove 9 receives therein a spring 10 for pressing the protrusion 8 so as to clockwise urge the latch 6 as shown in FIG. 2.

A ratchet 11 is journalled to a shaft 12 parallel with the latch shaft 7 within the recess 5 below the latch 6. The ratchet 11 is urged counterclockwise by a spring (not shown). A pawl 13 formed on the ratchet 11 is engaged with a first engaging part 14 of the latch 6 when the latch 6 is rotated from an open position shown in FIG. 2 to a half-latch position shown in FIG. 3, and is then finally engaged with a second engaging part 15 of the latch 6 when the latch is rotated to a full-latch position as shown in FIG. 4. A protrusion 17 is formed at the front end of the ratchet 11 so as to be projected rearward through an elongated hole 16 formed in the lock body 3. The ratchet 11 which will be detailed hereinbelow, is released from the latch 6 since the protrusion 17 is pressed and rotated when one of open handles 56, 60 (shown in FIG. 1) on the door is manipulated.

Figure 2:
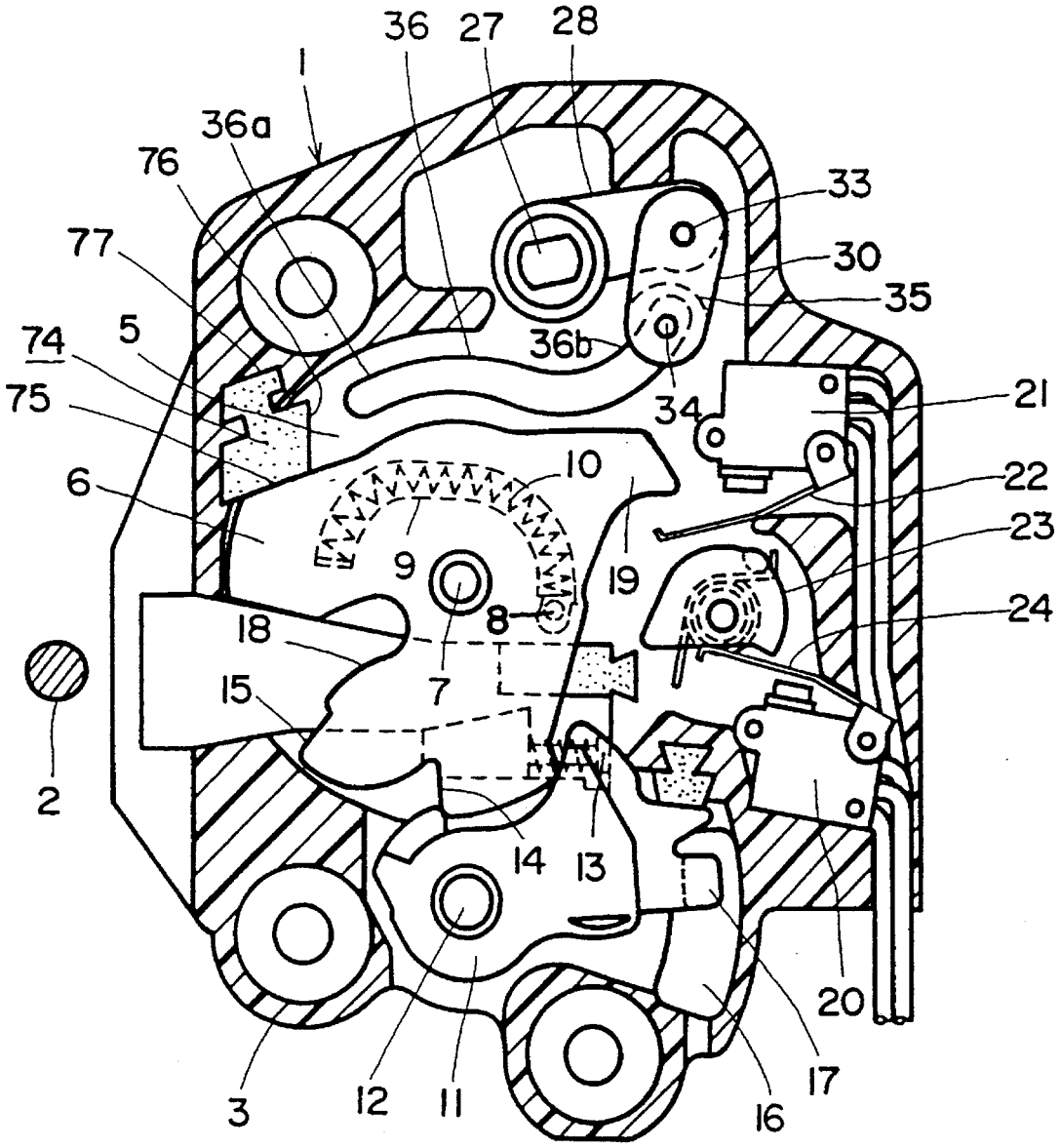
FIG. 2 is a longitudinal sectional view illustrating a locking apparatus in an open condition.

Referring to FIG. 2, on the right side of the latch 6, there are provided a half-latch switch 20 adapted to be turned on when the latch 6 which has been located at the open position is rotated to the half-latch position, and a full-latch switch 21 adapted to be turned on when the latch is rotated to the full-latch position. An actuating arm 22 of the full-latch switch 21 is arranged to be directly pressed as shown in FIG. 4, but an actuating arm 24 of the half-latch switch 20 is arranged to be indirectly pressed through the intermediary of a roller 23 which is adapted to abut against the latch 6 so as to be rotated. These switches 20, 21 are connected to a controller 26 for an actuator 25 as shown in a block diagram in a lower part of FIG. 6. The controller 26 operates the actuator 25 when the half-latch switch 20 is turned on, but stops the actuator 25 when the full-latch switch 21 is turned on.

Figure 3:
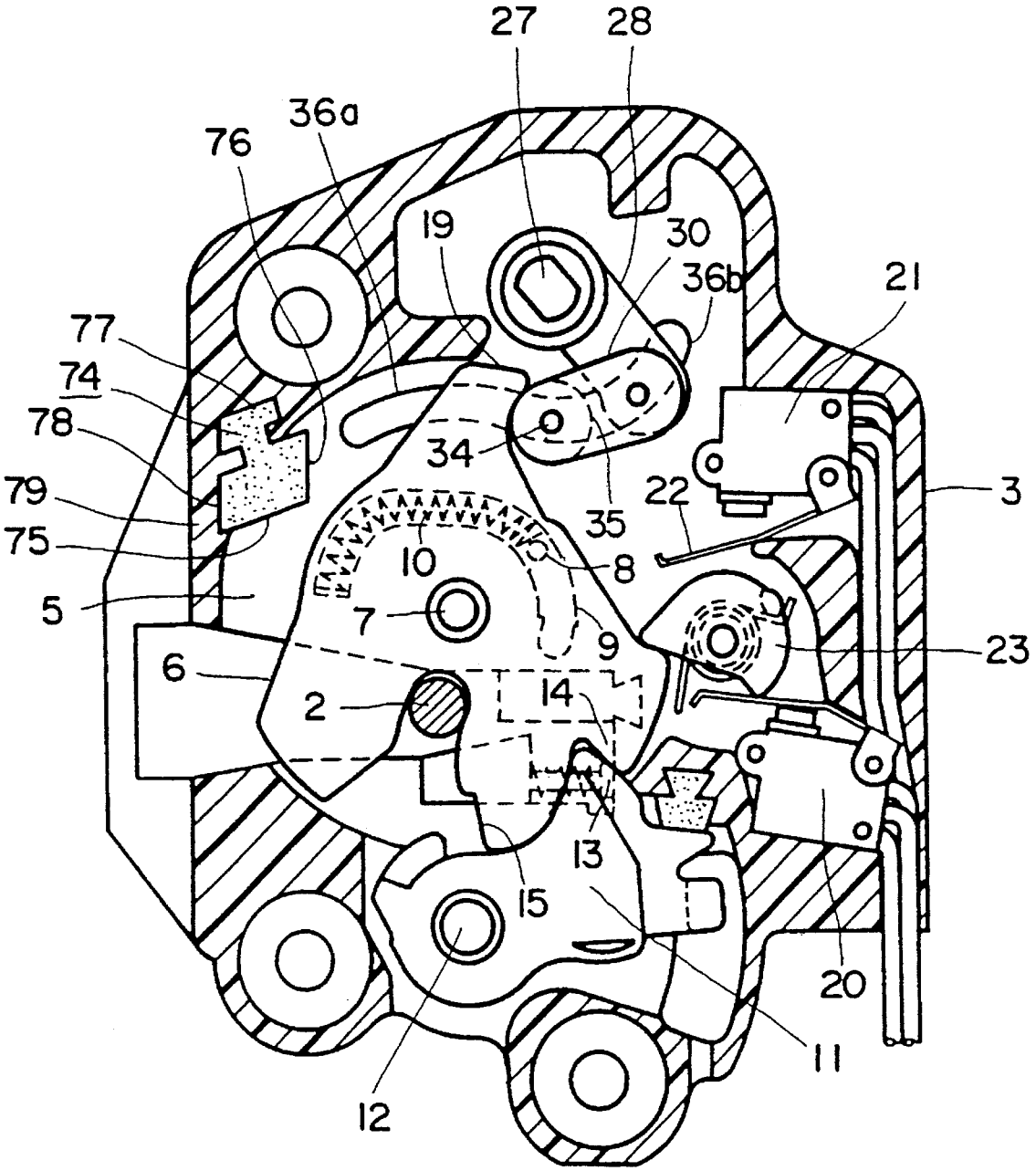
FIG. 3 is a longitudinal sectional view illustrating the locking apparatus in a half latch condition.
Figure 4:
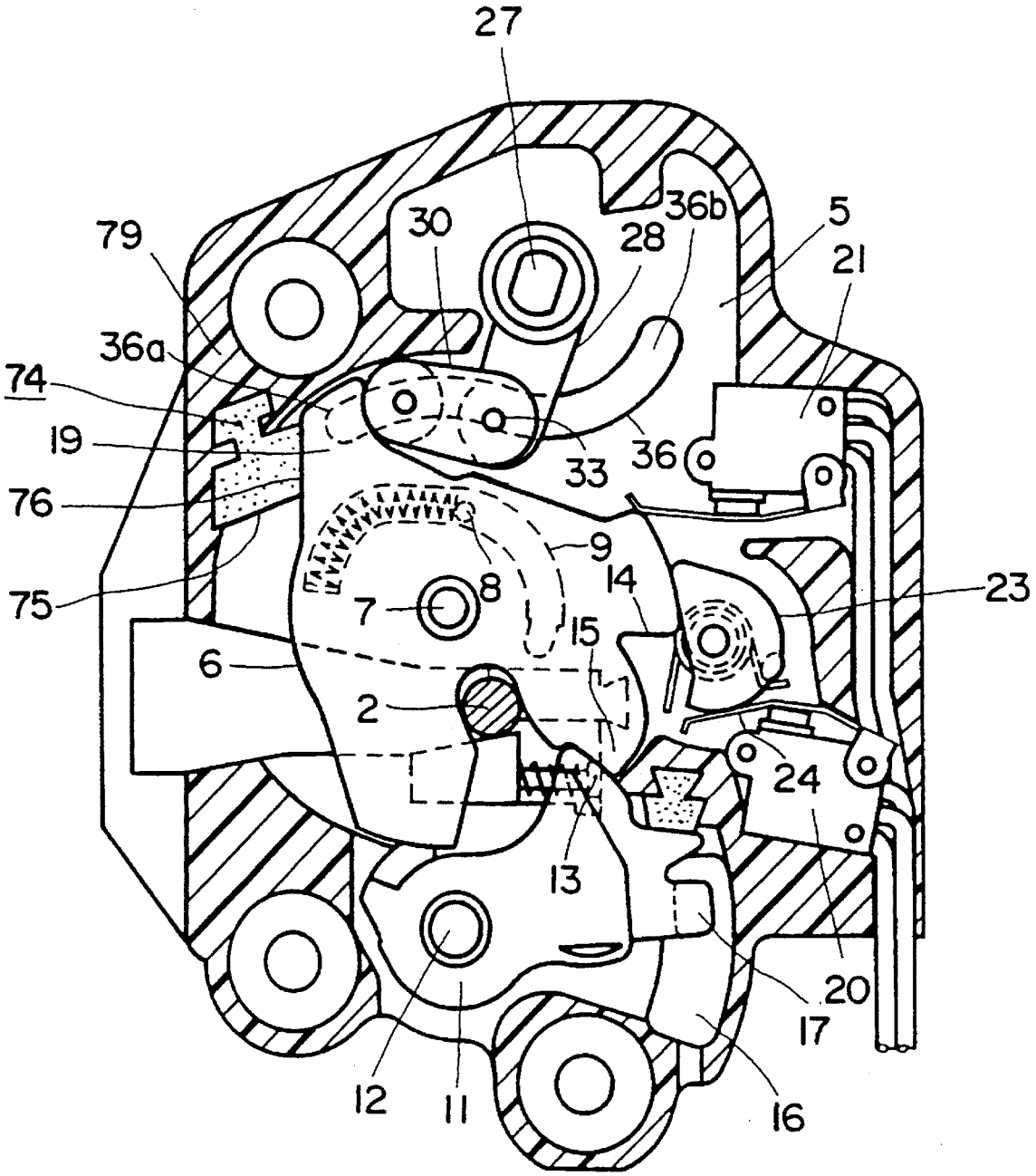
FIG. 4 is a longitudinal sectional view illustrating the locking apparatus in a full-latch condition.

The above-mentioned latch 6 is integrally incorporated with an engaging leg part 19 which is projected upright when the latch 6 is rotated up to the half-latch position, as shown in FIG. 3.

A link lever 28 is located in the recess 5 at a position above the latch 6. The link lever 28 is fixed to a rotary shaft 27 parallel with the latch shaft 7, and the rotary shaft 27 is coupled to the actuator 25 through the intermediary of a power transmission mechanism 29 shown in the upper part of FIG. 6 so that the rotary shaft 27 is rotated clockwise, as shown in FIG. 2, when the actuator 25 is energized.

Figure 5:
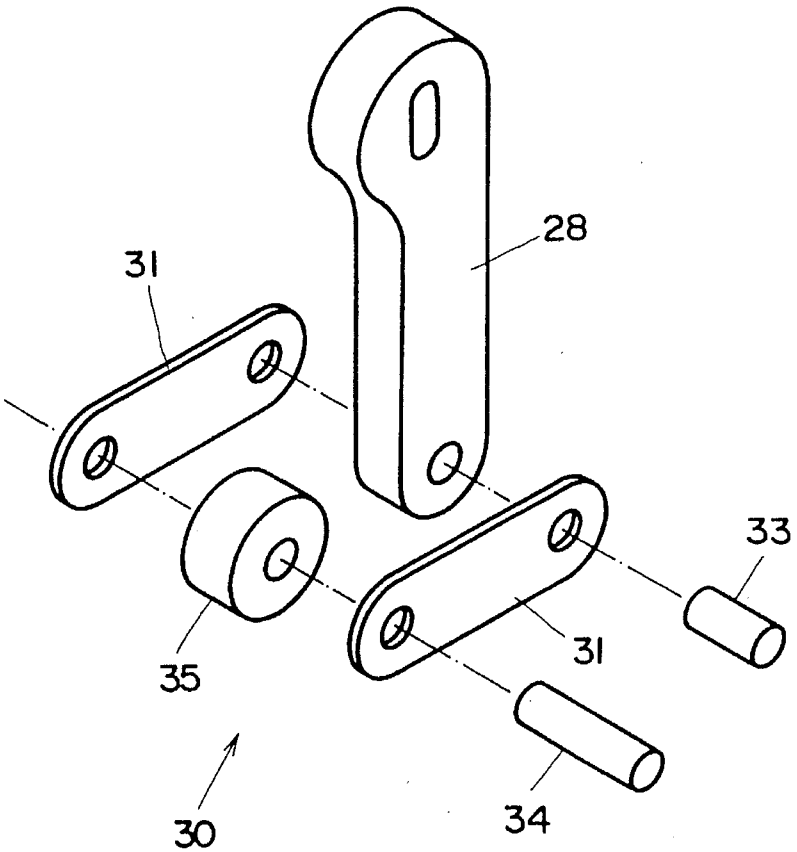
FIG. 5 is an exploded perspective view illustrating a slide member.
Figure 12:
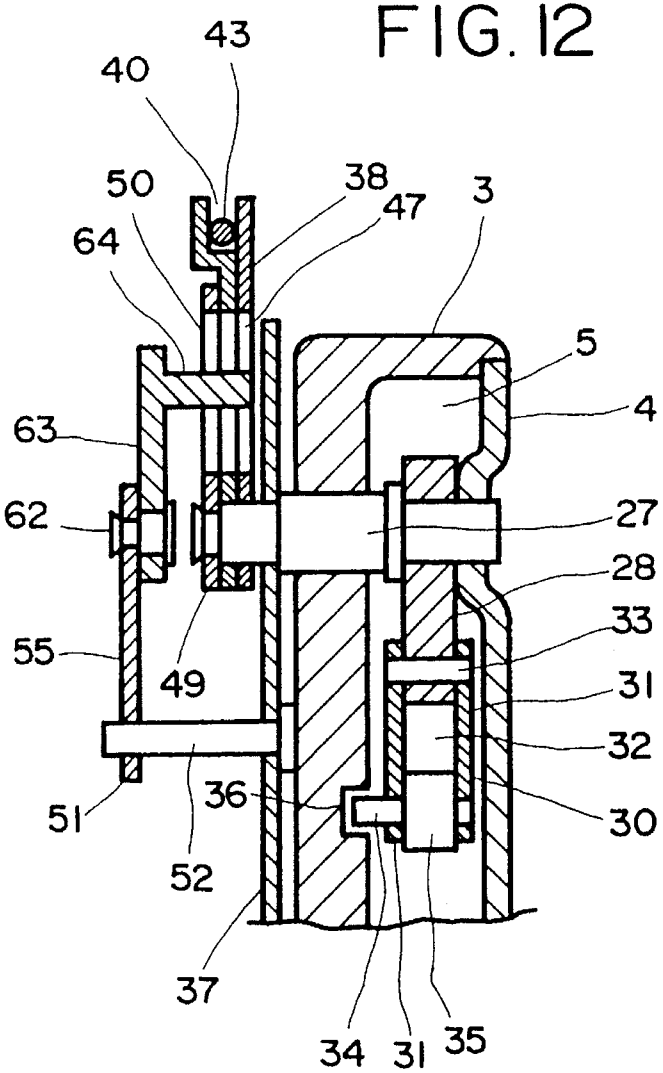
FIG. 12 is a longitudinal sectional side view illustrating the locking apparatus.

The link lever 28 is attached thereto with a slide member 30 having a pair of plates 31, 31 and a roll 35 as shown in FIGS. 5 and 12, the base parts of the plates 31, 31 being journalled to the opposite sides of the front end part of the link lever 28 by means of a shaft 33, and the roller 35 being rotatably journalled to the front end parts of the plates 31, 31 by means of a guide pin 34.

The guide pin 34 is comparatively longer than the shaft 33, having one end part entering a guide groove 36 formed in the lock body 3, as shown in FIG. 12. The guide groove 36 has a long length, and horizontally extends between the latch 6 and the rotary shaft 27, having a left half part serving as a substantially arcuate groove **36*a* surrounding the latch shaft 7 as a rotating center, and the right half part serving as a substantially arcuate retraction groove 36b surrounding the rotary shaft 27** as a rotating center.

When the latch 6 is rotated from the open position to the half-latch position, the link lever 28 is rotated by the actuator 25 which is energized by the half-latch switch 20, and the roller 35 is shifted right to left along the guide groove 36, and abuts against the engaging leg part 19 of the latch 6 so that the latch 6 is forcibly moved to the full-latch position (refer to FIG. 4). Accordingly, when the door is lightly closed, the latch 6 is rotated by the power of the actuator 25, and accordingly, the door A can be completely closed.

A rubber stopper 74 for limiting the rotational range of the latch 6 is attached to the peripheral wall 79 of the recess 5. The rubber stopper 74 has a first contact surface 75 against which the latch 6 having returned to the open position by means of the spring 10 abuts, as shown FIG. 2, and a second contact surface 76 against which the latch 6 having come to the full-latch position abuts, as shown in FIG. 4.

A back plate 37 is fixed to the rear surface side of the lock body 3 (refer to FIG. 12), and the rear end part of the rotary shaft 27 pierces through the back plate 37 and projects rearward therefrom. The base part of a sector shape output lever 38 is rotatably attached to the projecting part of the rotary shaft 27 so that the output lever 38 can be rotated, independent from the rotary shaft 27. The output lever 38 in this embodiment is formed with two metal plates which are joined together, having its outer peripheral edge formed therein a U-like guide groove 40. One end part 41 of the guide groove 40 is formed therein a hook 42 with which the head 44 of a wire 43 is engaged. The wire 43 is wound around the guide groove 40, is extended downward, and is then connected to the above-mentioned actuator 25.

Figure 6:
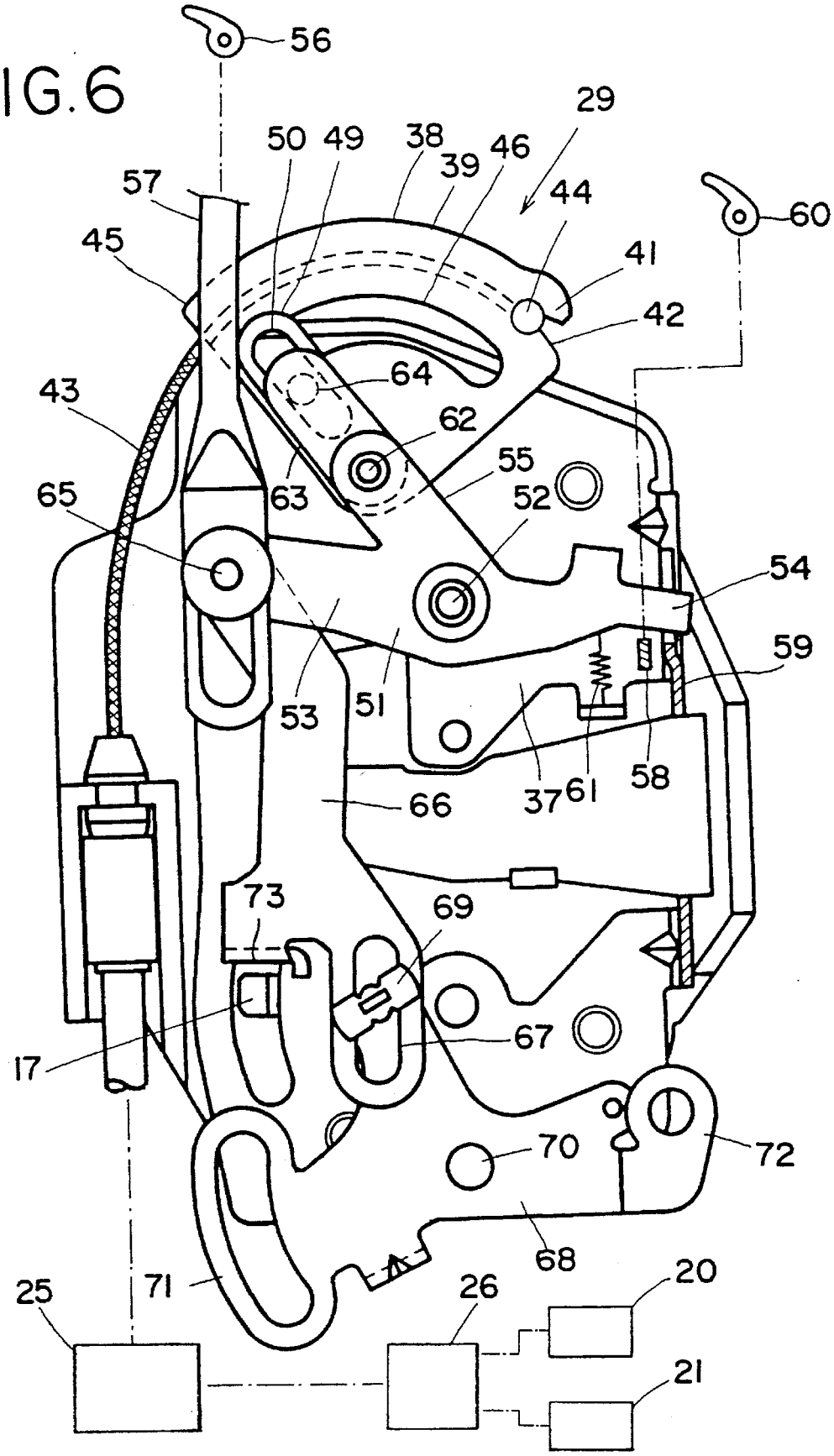
FIG. 6 is a rear view illustrating the locking apparatus in an open condition.

The output lever 38 is urged clockwise by a spring (not shown) as shown in FIG. 6. The output lever 38 is formed therein with an L-like engaging hole 48 consisting of an arcuate hole 46 about the rotary shaft 27 as a rotational center, and a radial hole 47 which is extended from the one end part of the arcuate hole 46 toward the rotary shaft 27.

A rotary lever 49 is fixed to the rearward projecting part of the rotary shaft 27. Accordingly, the rotary lever 49, the rotary shaft 27 and the link lever 28 are integrally rotated. The rotary lever 49 is formed therein an elongated hole 50 corresponding to the radial hole 47.

An open lever 51 is journalled by means of a shaft 52 to the rear side of the lock body 3 at a position below the rotary shaft 27. The open lever 51 has a left arm 53 coupled to an outer open handle 56 on the door A through the intermediary of a rod 57, a right arm 54 engaged with an inner lever 58 (refer to FIG. 6) adapted to be rotated when an inner open handle 60 on the door A is manipulated, and an intermediate arm 55. Further, a link 66 is journalled at its upper end to the left arm 53 by means of a shaft 65. The open lever 51 is rotated counterclockwise, overcoming the resilient force of the spring 61 when the open handle 56 or 60 is manipulated so as to move the link 66 downward. When the link 66 is moved downward, an abutting piece 73 of the link 66 depresses the protrusion 17 of the ratchet 11 which is therefore released from the latch 6.

A movable rod 63 is rotatably attached to the intermediate shaft 55 through the intermediary of a shaft 62. Further, the movable rod 63 is formed thereon a pin 64 which is inserted in the engaging hole 48 of the output lever 38 and in the elongated hole 50 in the rotary lever 49.

The center axis of the shaft 62 is aligned with the center axis of the rotary shaft 27 when the open lever 51 is held by means of a spring 61 at a position as shown in FIG. 6, and at this time, the pin 64 is engaged in the radial hole 47 of the output lever 38 and in the elongated hole 50 of the rotary lever 49. Accordingly, in the condition shown in FIG. 6, the output lever 38 and the rotary lever 49 are coupled together by means of the pin 64, and accordingly the output lever 38 and the rotary lever 49 are rotated counterclockwise when the wire 43 is wound up by the actuator 25. Thus, the link lever 28 is also rotated in association with the rotation of the rotary lever 49 through the intermediary of the rotary shaft 27.

Figure 9:
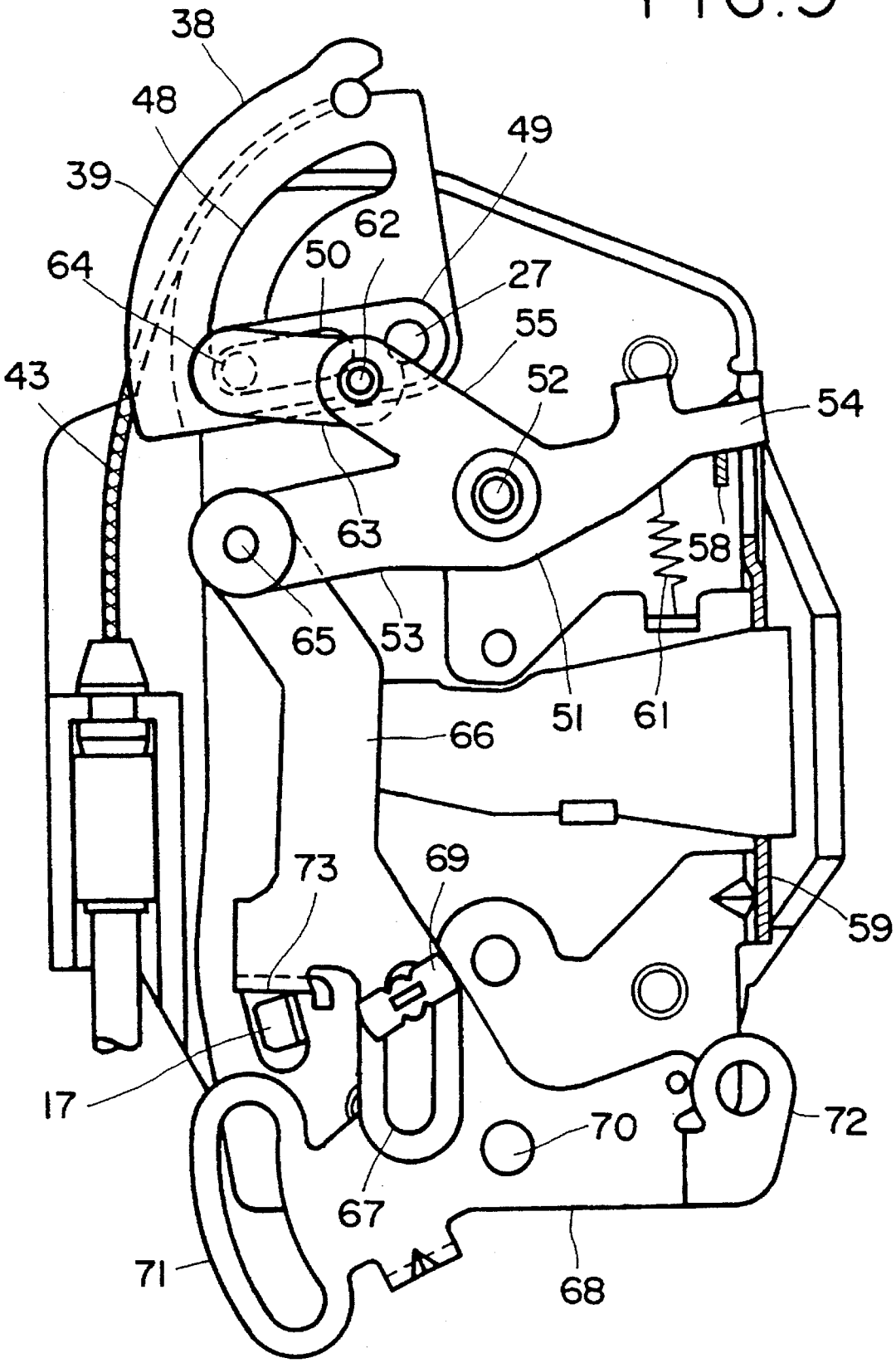
FIG. 9 is a view illustrating a condition such that a safety mechanism is operated by rotating an open lever.
Figure 10:
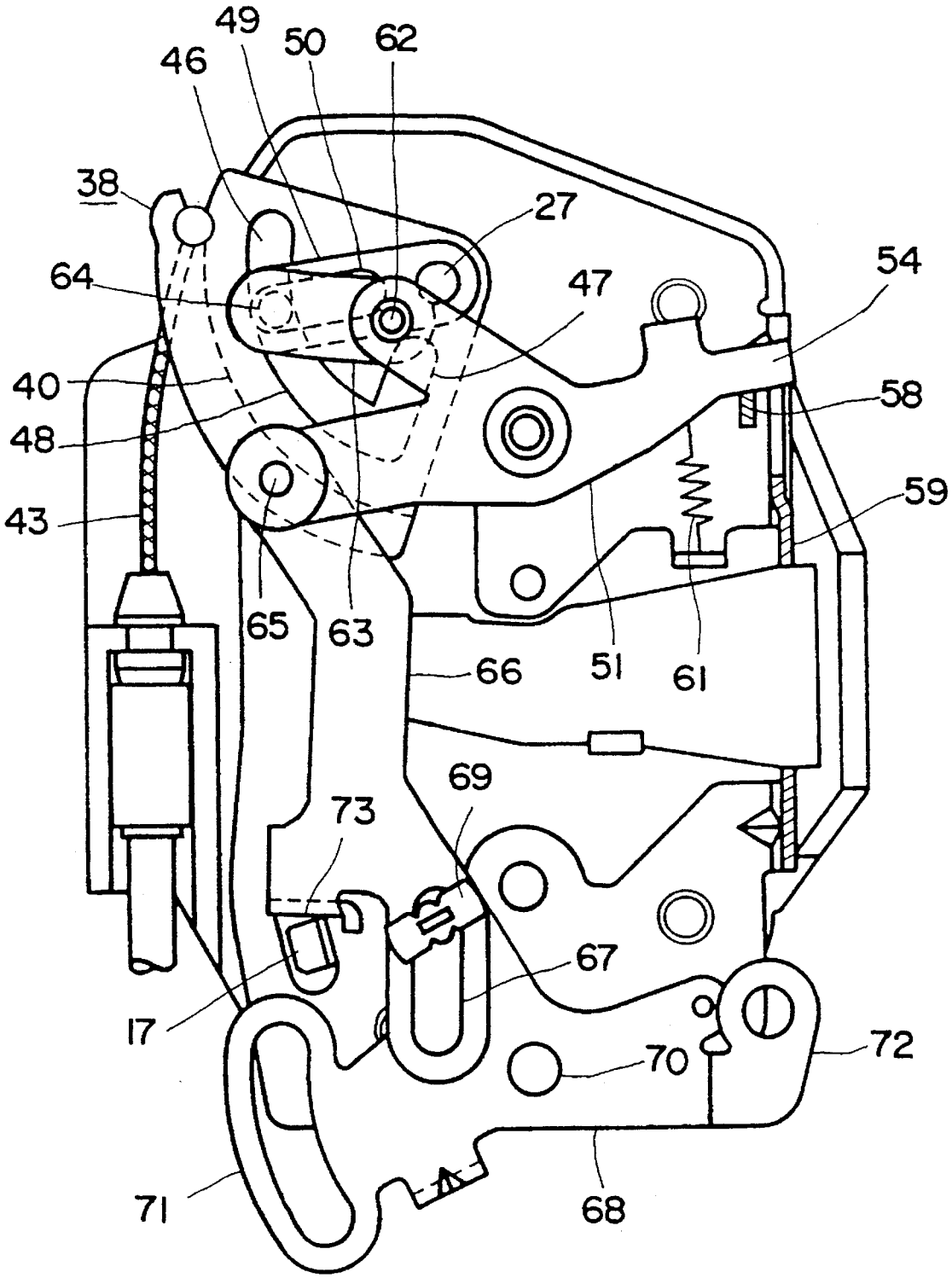
FIG. 10 is a view showing a condition such that an output lever is solely rotated from the condition shown in FIG. 9.
Figure 11:
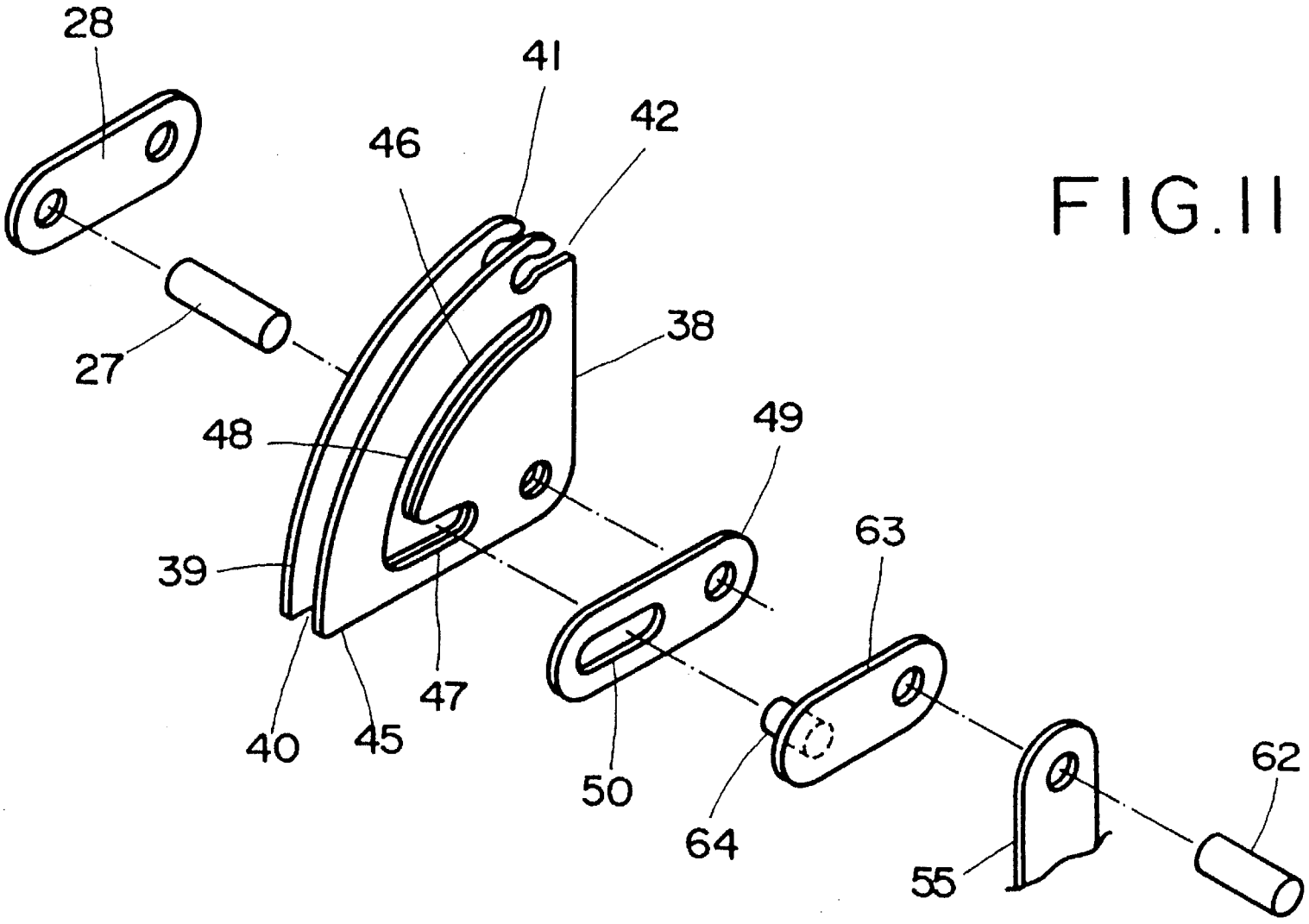
FIG. 11 is an exploded perspective view illustrating a power transmission mechanism.
Figure 13:
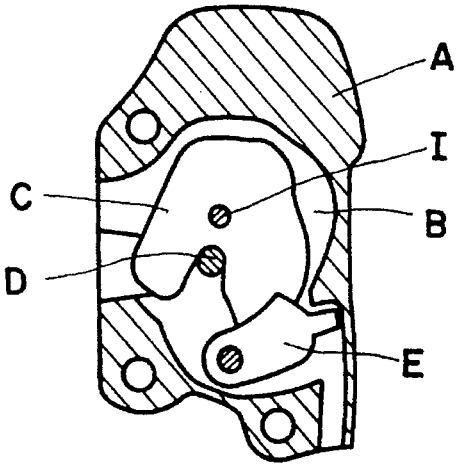
FIG. 13 PRIOR ART
FIG. 13 is a longitudinal sectional view illustrating a conventional lock body.
Figure 14:
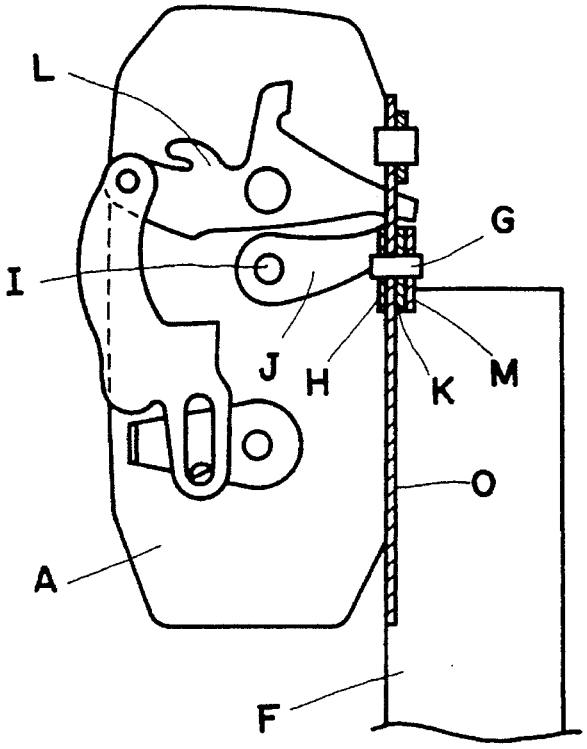
FIG. 14 PRIOR ART
FIG. 14 is a rear view illustrating the conventional lock body.
Figure 15:
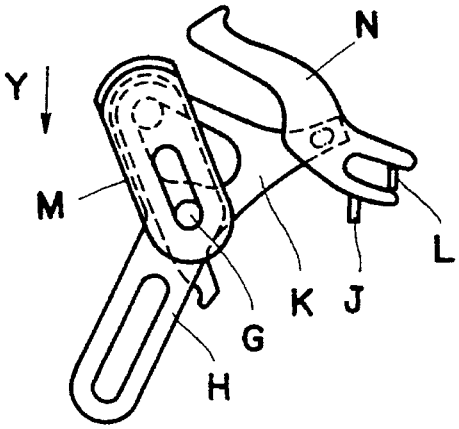
FIG. 15 PRIOR ART
FIG. 15 is a side view illustrating a conventional transmission member.

The center axis of the shaft 62 is shifted from the center axis of the rotary shaft 27, as shown in FIG. 9, when the open lever 51 is rotated by the open handle 56 or 60, and accordingly, the pin 64 is shifted from the radial hole 47 to the arcuate hole 46. As a result, the coupling between the output lever 38 and the rotary lever 49 is released. Accordingly, when the open lever 51 is rotated during operation of the actuator 25, the output lever 38 is solely rotated as shown in FIG. 10, and accordingly, the transmission of the power to the latch 6 can be cut off. This mechanism gives a safety mechanism for an automatic closing mechanism.

A lock lever 68 is rotatably journalled to the rear side of the lock body 3 at a lower position by means of a shaft 70. One end 71 of the lock lever 68 is connected to a key cylinder (not shown) through a lost motion, and the other end 72 thereof is connected to an inner lock manipulating member. The lock lever 68 has a protrusion 69 which is engaged in an elongated hole 67 formed in the lower end part of the link 66.

The lock lever 68 is shifted between a lock position and an unlock position as is well-known. At the unlock position (refer to FIG. 6) an abutting piece 73 of the link 66 is located face-to-face to the protrusion 17 of the ratchet 11, and accordingly, when the link 66 is moved downward by means of the open lever 51, the abutting piece 73 depresses the protrusion 17 of the ratchet 11 so that the ratchet 11 is released from the latch 6, thereby it is possible to open the door. When the lock lever 68 is rotated clockwise from the position shown in FIG. 6, a locking condition is effected, and accordingly, the abutting piece 73 of the link 66 is shifted rightward from the protrusion 17 of the ratchet 11 so that the abutting piece 73 is not engaged with the protrusion 17 even though the open lever 51 is manipulated for opening the door, thereby the door cannot be opened.

Explanation will be hereinbelow made of the operation of the door lock device.

In a condition shown in FIGS. 2 and 6, the door A is opened so that the latch 6 abuts against the first contact surface 75 of the rubber stopper 74, and accordingly, the latch 6 is stopped. In this condition, the door A is smoothly closed with a light force, the striker 2 on the vehicle body B is moderately engaged in the engaging groove 18 in the latch 6 which is therefore rotated to the half-latch position so that the pawl 13 of the ratchet 11 is engaged with the first engaging part 14 of the latch 6. When the door A is closed with a weak force, should the lock device be not incorporated therein with an automatic closing mechanism, the rotating power of the door A should be consumed at this stage, and accordingly, the door A would come to a stop on its way without being completely closed.

However, according to the present invention, when the latch 6 is rotated to the half-latch position, the member 23 having been rotated by the latch 6, depresses the actuating arm 24 so as to turn on the half-latch switch 20. Thus, the actuator 25 is energized to wind up the wire 43, and accordingly, the output lever 38 is rotated counterclockwise in FIG. 6.

Figure 7:
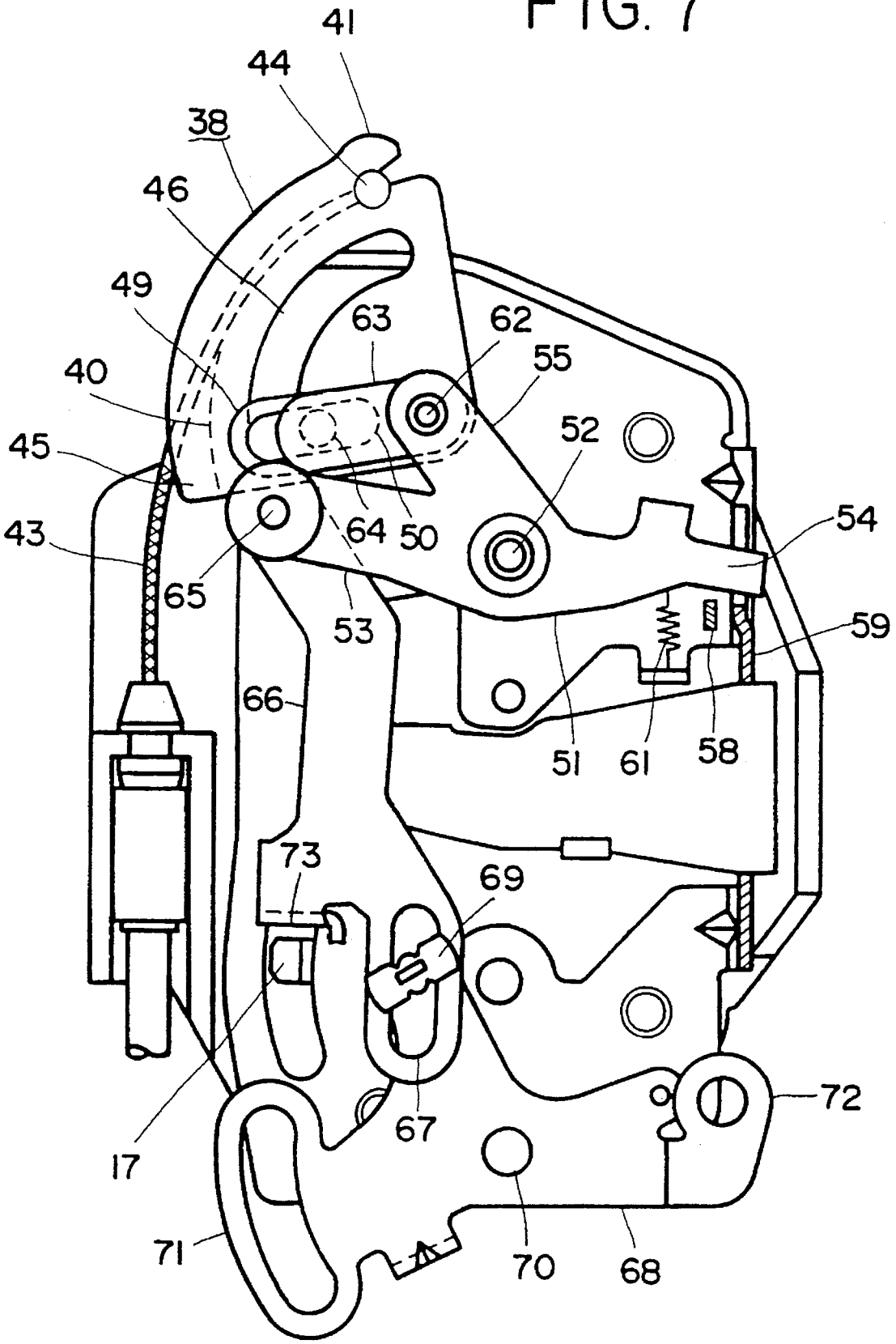
FIG. 7 is a rear view illustrating the locking apparatus in a half-latch condition.
Figure 8:
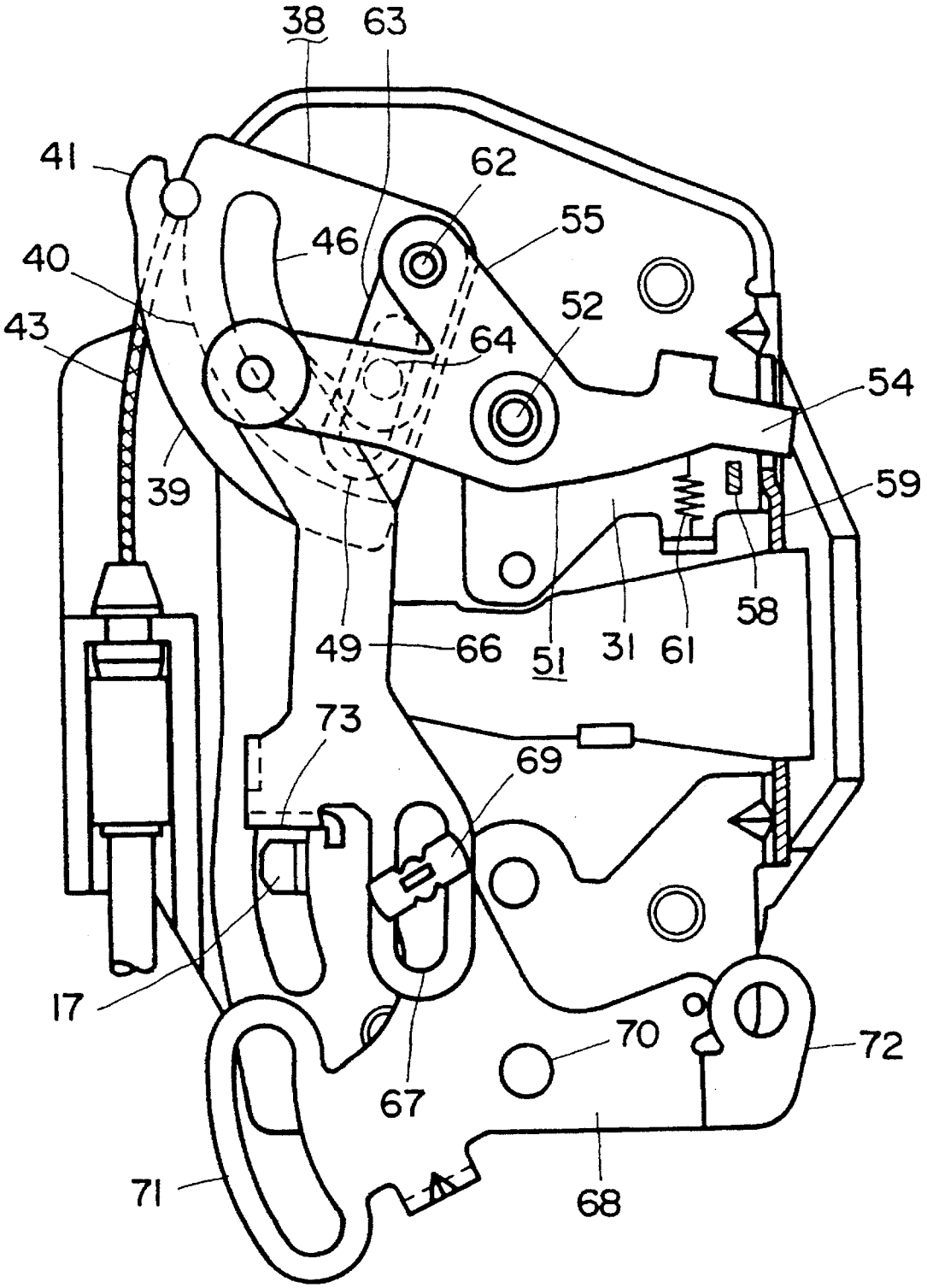
FIG. 8 is a rear view illustrating the locking apparatus in a full-latch condition.

When the output lever 38 is rotated, the rotary lever 49 is also rotated since the pin 64 is engaged in the radial hole 47 of the output lever 38 and in the elongated hole 50 of the rotary lever 49, and accordingly, the link lever 28 which is fixed to the rotary lever 49 through the intermediary of the rotary shaft 27 is also rotated clockwise in FIG. 2. Thus, the roll 35 of the slide member 30 is moved from the right side to the left side along the guide groove 36, and when the roll 35 comes to the middle of the guide groove 36, it abuts against the engaging leg part 19 of the latch 6 located at the half-latch position. The condition at this time is shown in FIGS. 3 and 7.

When the actuator 25 is rotated further from the above-mentioned position, the roll 35 is guided along the arcuate groove **36*a* so that the latch 6 is moved to the full-latch position as shown in FIG. 4, without coming off from the engaging leg part 19, and accordingly, the pawl 13 of the ratchet 11 is engaged with the second engaging part 15 of the latch 6. Further, the engaging leg part 19 of the latch 6 makes contact with the second contact surface 76 of the rubber stopper 74. In this condition, the actuator 25 is still energized, and accordingly, when the latch 6 is further moved more or less, the latch 6 abuts against the actuating arm 22 of the full-latch switch 21 which is therefore turned on, resulting in deenergization of the actuator 25**.

During the series of the operation, an unexpected accident such that a hand is caught by the door A on closing, it is necessary to stop at once the forcible door closing operation by the actuator 25. Accordingly to the present invention, in order to cope with the accident, the provision is made such that the power transmission mechanism 29 from the actuator 25 to the link lever 28 is cut off when the open handle 56, 60 on the door is manipulated.

That is, when the open lever 51 is rotated by manipulating the open handle 56 or 60, the center axis of the shaft 62 is shifted from the center axis of the rotary shaft 27 so that the pin 64 is moved from the radial hole 47 to the arcuate hole 46 of the output lever 38, and accordingly, the coupling between the output lever 38 and the rotary lever 49 is released so that the rotary lever 49 and the roll 35 which are moved integrally with the rotary lever 49 become free. Meanwhile, the link 66 is moved downward in association with the rotation of the open lever 51 so that the abutting piece 73 depresses downward the protrusion 17 of the ratchet 11, and accordingly, the ratchet 11 is released from the latch 6. Accordingly, the latch 6 becomes free from both roll 35 and ratchet 11, and is therefore rotated toward the open position by the resilient force of the spring 10. Thus, if the open handle 56 or 60 is manipulated without hesitation upon occurrence of an accident, the door A can be opened, thereby it is possible to restrain damage as far as possible.

Since the above-mentioned slide member 30 is arranged to depress the engaging leg part 19 of the latch 6 through the intermediary of the roll 35 so as to move the latch 6, no unreasonable force is applied to the latch 6, and accordingly, the latch 6 can be smoothly moved. Further, even though the plate 31 of the slide member 30 is formed of a thin metal sheet, it is possible to bear against a large load.

It is noted that the latch 6 is located at the full-latch position as shown in FIG. 4 while the slide member 30 is located at a stand-by position as shown in FIG. 2 so that the roll 35 of the slide member 30 is shifted from the moving locus of the engaging leg part 19 of the latch 6. Accordingly, even though the latch 6 becomes free due to the door opening operation, the engaging leg part 19 does not make contact with the roll 35, and accordingly, the latch 6 can be smoothly rotated toward the open position by the resilient force of the spring 10.

Further, according to the present invention, if the door A is closed strongly as shown in FIG. 2, the striker 2 is engaged in the engaging groove 18 in the latch 6 which is therefore rotated under inertia, as is similar to the conventional one the latch 6 is rotated to the full-latch position as shown in FIG. 4, and accordingly, the door can be closed with no use of the power of the actuator 25. Thus, even though the actuator 25 accidentally fails, the vehicle can be moved with no hindrance.

Further, since the rotating range of the latch 6 is limited only one rubber stopper 74, the provision of only one kind of a rubber stopper 74 is sufficient, thereby it is possible to facilitate the assembly of the lock device.

What is claimed is:

1. A door lock device with an automatic door closing mechanism, comprising:

a lock body having a front surface side formed therein a recess substantially covered by a metal plate;

a spring returned type latch adapted to be engaged with a striker fixed to a vehicle body so as to be rotated from an open position to a full-latch position by way of a half-latch position;

a ratchet adapted to be engaged with the latch so as to hold the engagement between the latch and the striker;

an actuator adapted to be operated when the latch is rotated to the half-latch position;

an output lever adapted to be rotated by power of the actuator; and a link lever which is rotated in association with any rotation of the output lever so as to move the latch from the half-latch position to the full-latch position;

wherein said latch, said ratchet and said link lever are stored in said recess of said lock body, and said output lever is provided on the rear surface side of the lock body, and said link lever is rotatably attached to a slide member having a roller abutting an outer periphery of said latch to allow said roller to press and move said latch when said link lever is rotated.

2. A door lock device as set forth in claim 1, wherein the rotating axis of said link lever is aligned with the rotating axis of said output lever.

3. A door lock device as set forth in claim 1, wherein said latch, said link lever and said output levers have their shafts whose rotating axes are arranged in parallel with one another.

4. A door lock device as set forth in claim 1, further comprising a first sensor for detecting said latch at the half-latch position, and a second sensor for detecting said latch at the full-latch position, wherein said actuator is energized when the first sensor detects said latch at the half-latch position, but said actuator is deenergized when said second sensor detects said latch at the full-latch position.

5. A door lock device as set forth in claim 1, wherein said recess has a peripheral wall attached thereto with a single rubber stopper having a first contact surface which makes contact with said latch when said latch is returned by said spring, and a second contact surface which makes contact with said latch when said latch is further rotated, overriding the full-latch position.

6. A door lock device with an automatic door closing mechanism, comprising:

a latch adapted to be engaged with a striker fixed to a vehicle body so as to be moved from an open position to a full-latch position by way of a half-latch position;

a latch adapted to be engaged with said ratchet so as to hold the engagement between the striker and the latch;

an actuator adapted to be operated when said latch is rotated to the half-latch position;

an output lever adapted to be rotated around a first shaft by power of the actuator;

a link lever adapted to be rotated in association with the rotation of the output lever so as to move the latch from the half-latch position to the full-latch position;

an open lever coupled to an open handle of a door, for releasing said ratchet from the latch when it is rotated; and a movable rod journalled rotatably to the open lever by means of a second shaft laid coaxially with said first shaft, and connecting the output shaft with the link lever;

whereby said movable rod is adapted to be moved in association with a shift of the center axis of the second shaft from the center axis of the first shaft upon rotation of the open lever so as to release the engagement between the output lever and the link lever.

7. A door lock device as set forth in claim 6, wherein said output lever is formed therein a first hole having a radial hole extending radially from said first shaft, and an arcuate hole extending from a front end of the radial hole along an arc around said first shaft as a center, said link lever is formed therein with a second hole corresponding to said radial hole, and said movable rod is formed thereon with a pin adapted to be inserted in said first and second holes.

8. A door lock device as set forth in claim 1, wherein the roller moves and is guided along a slot in the lock body.

* * * * *